United States Patent [19]

Lemaire, Jr.

[11] Patent Number: 4,986,323

[45] Date of Patent: Jan. 22, 1991

[54] ADJUSTABLE STOP APPARATUS

[76] Inventor: Albert L. Lemaire, Jr., Rte. 4, Box 548, New Iberia, La. 70560

[21] Appl. No.: 520,362

[22] Filed: Apr. 13, 1990

[51] Int. Cl.[5] ..... B27B 31/00

[52] U.S. Cl. ..... 144/253 R; 33/613; 33/813; 33/831; 33/838; 83/467.1; 269/315

[58] Field of Search ..... 83/431, 438, 446, 450, 83/467, 468; 269/315; 33/838, 831, 821, 813, 613; 144/253 R

[56] References Cited

U.S. PATENT DOCUMENTS

| | | | |
|---|---|---|---|
| 2,560,850 | 7/1951 | Day | 33/813 |
| 2,986,737 | 6/1961 | Chafin | 269/315 |
| 4,030,718 | 6/1977 | Philipoff | 269/315 |

*Primary Examiner*—W. Donald Bray
*Attorney, Agent, or Firm*—Pravel, Gambrell, Hewitt, Kimball & Krieger

[57] ABSTRACT

Apparatus, having a principal body portion which is in the form of a box-like configuration, and a screw member threadably engaged into a port in the face of the body portion. The screw member includes a four flat sided body portion on its end, with a portion of the body portion threaded to threadably engage into the body of the apparatus. There is further included a spring loaded second screw member on a second face of the body meeting said perpendicular to the setting of the first screw, so that the end portion of the spring loaded second screw makes contact with the four flat sided body of the principal screw member. The four flat sided body is so calibrated so that as one complete turn of the principal screw is made, the screw either moves inward or outward 1/16 of an inch. Furthermore, each time one of the four flat faces of the body is moved to make contact with the second screw member, the screw has moved in or out a distance of 1/64 of an inch.

5 Claims, 2 Drawing Sheets

ADJUSTABLE STOP APPARATUS

BACKGROUND OF THE INVENTION

1. Field of the Invention

The apparatus of the present invention relates to wood cutting. More particularly, the present invention relates to an apparatus which is mountable to the platform of a table saw which enables incremental adjustments to ensure a proper length of cut.

2. General Background

In the field of wood cutting, the wood is often cut to a particular length through the use of a table saw. In this manner, the blade of the table saw extends upward from the base of the saw, and a piece of wood is pushed across the blade in a controlled manner with an accessory called a miter fence, and the blade cuts through the wood. In order to insure that the wood is being cut to a proper length, a scrap of wood is clamped to the adjustable fence which is slidable along the base of the saw, so that when the fence is adjusted to a certain distance from the blade, the piece of wood is placed against the scrap that is clamped to the fence, and the cut is made for the measurement between the scrap and the blade. (The scrap being in such position that the wood being cut cannot be touching the scrap and the blade at the same time.) However, one of the shortcomings that is involved in this type of cutting is the fact that the adjustable fence can not be set carefully enough for some classes to work. Most metal working machine tools include adjustable stops. Some of the types of stops are simply screws with jamb nuts, and some of the stops include calibrated dials for direct setting of measurement. Micrometers are utilized to measure by feel rather than sight. But since wood cannot be cut as closely as metal, these same devices are not commonly found on wood cutting machines.

SUMMARY OF THE PRESENT INVENTION

The present (invention solves the shortcomings of the art in a simple and straightforward manner. What is provided is an apparatus, having a principal body portion which is in the form of a box-like configuration, and a screw member threadably engaged into a port in the face of the body portion. The screw member includes a cylindrical portion with four flat sides, with a portion threaded to threadably engage into the body of the apparatus. There is further included a spring loaded second screw member on a second face of the body meeting said perpendicular to the setting of the first screw, so that the end portion of the spring loaded screw makes contact with the four flat sided cylindrical body of the principal screw member. The four flat sided body is so calibrated so that as one complete turn of the principal screw is made, the screw either moves inward or outward 1/16 of an inch. Furthermore, the screw head is provided with a flat section along its annular side wall, so that one may easily determine that the head of the screw has been rotated a complete turn when the flat portion returns to its original position. Furthermore, each time one of the four faces of the body is moved to make contact with the second screw member, the screw has moved in or out a distance of 1/64 of an inch.

Therefore, in its preferred use, the apparatus is positioned onto the table of the saw or the fence, and the end of the piece of wood is set against the top portion of the top face of the principal screw. The screw may then be screwed inwardly or outwardly a number of turns to move the cut-line in line with the saw blade. By utilizing this adjustable screw, one is able to move the wood in 1/64 of an inch increments, and therefore able to fall directly on the cut-line quite easily and effectively.

Therefore, it is the principal object of the present invention to provide an apparatus mountable onto a table saw which is utilized to move the wood to be cut in increments of at least 1/64 of an inch inwardly or outwardly, as the case may be; and It is still a further principal object of the present invention to provide an apparatus which enables one to accurately position a workpiece, whether it be wood, metal, or the like, and accurately move the position of the workpiece relative to the cutting member, so that the workpiece is properly positioned at a point between the apparatus and the cutting member.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
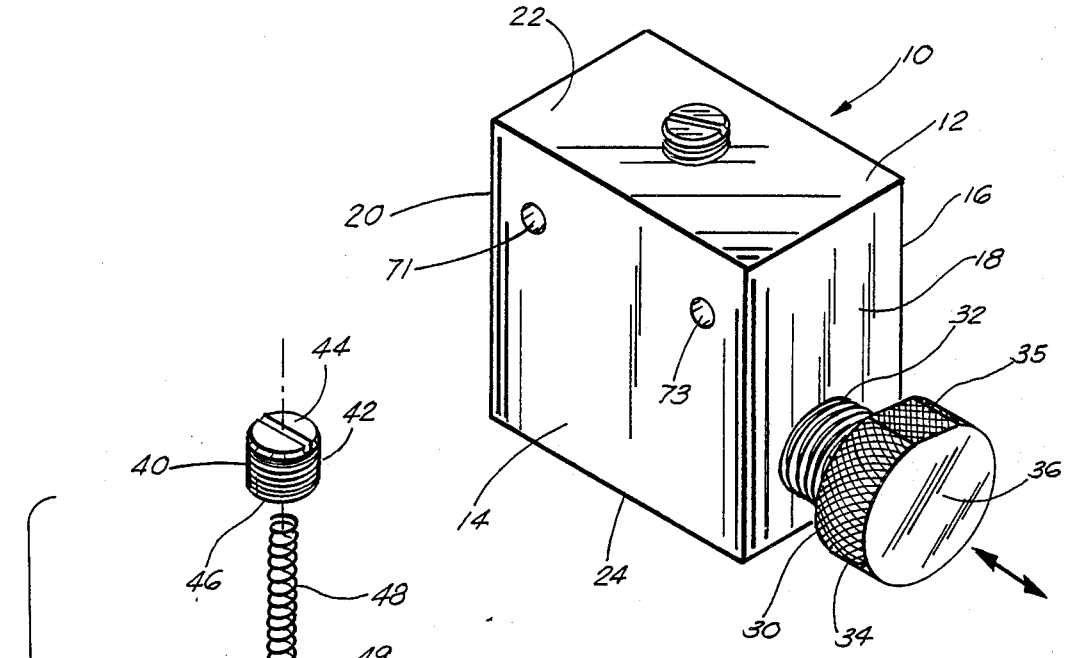
FIG. 1 illustrates an overall view of the preferred embodiment of the apparatus of the present invention.
Figure 2:
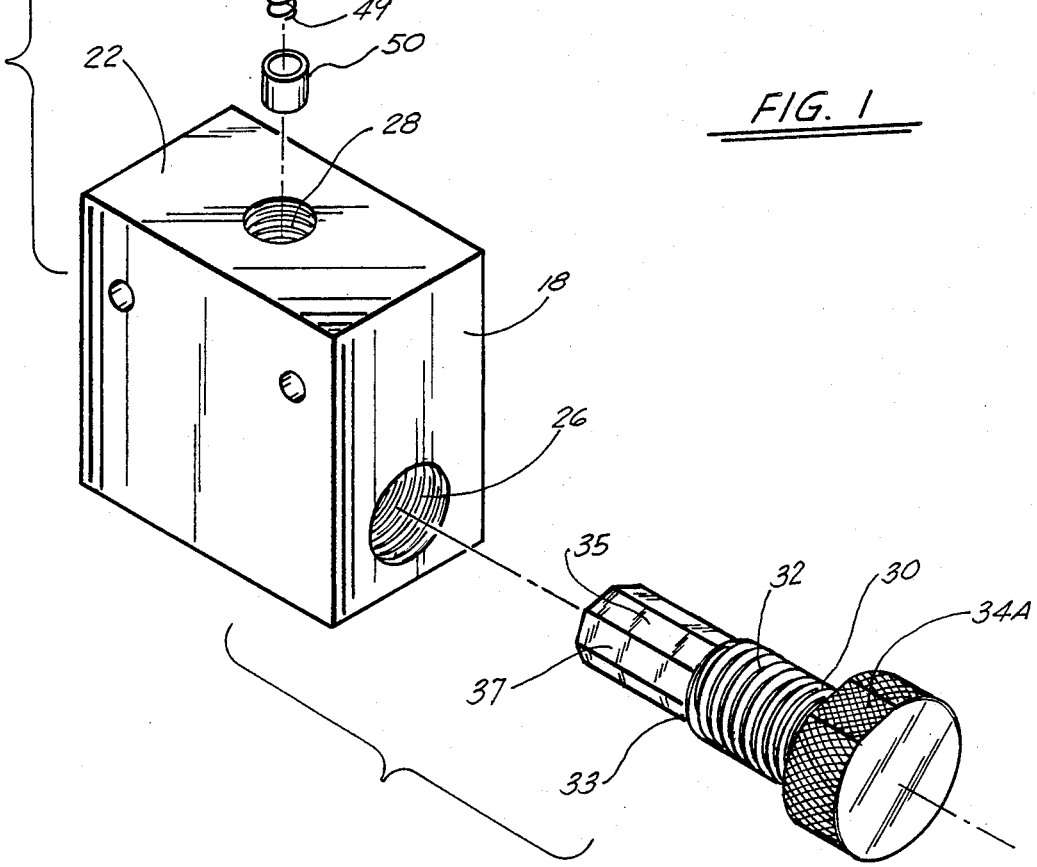
FIG. 2 illustrates an exploded view thereof.

FIGS. 1 through 5 illustrate the preferred embodiment of the apparatus by the numeral 10. As illustrated in the Figures, apparatus 10 would include a principal body portion 12, which would comprise a rectangular box having a pair of side walls 14, 16, a forward face wall 18, a rear wall 20, a top 22, and a base wall 24. Furthermore, apparatus 10 accommodated with a principal threaded port 26 on its forward face 18, and a second threaded port 28 on its top face 22, the function of which will be described further. As further illustrated, principal threaded port 26 would threadably accommodate a bolt member 30 having a threaded shaft portion 32, threadably engageable into threaded port 26, and a substantially circular knurled head portion 34, having a flat face 36. Further, head portion 34 of bolt member 30 would include a flat portion which serves as an indicator as bolt head 34 is rotated, as will be described further. Likewise, secondary threaded port 28 is provided with a screw member 40 having a threaded shaft 42, threadably engaged into threaded port 28, a screw top 44, and a cupped end portion 46. As seen in FIGS. 2 an 4, end portion 46 would make contact with a coil spring 48, the distal end 49 of which would be insertable into an internal cap member 50, again the function of which will be described further.

Figure 3:
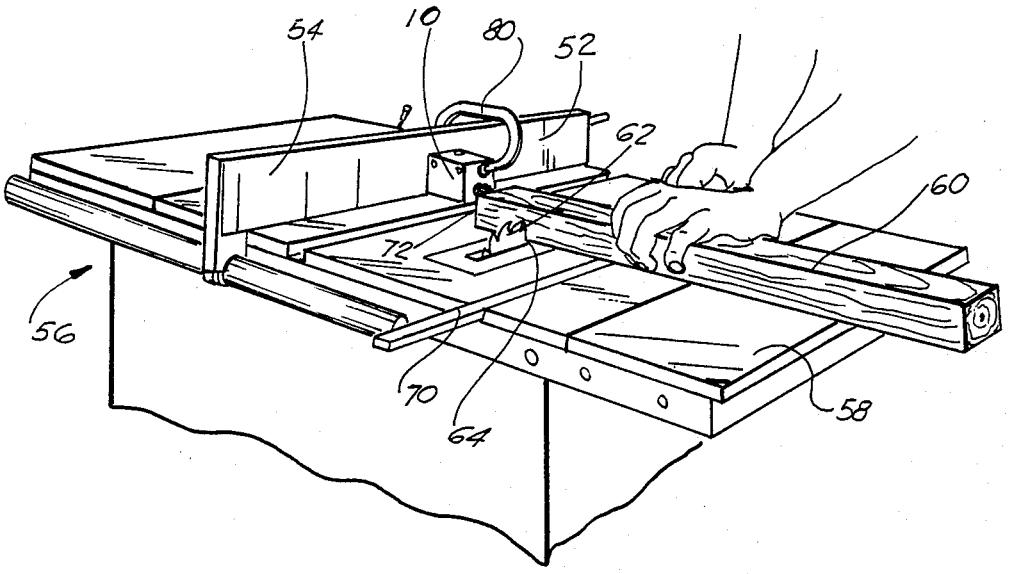
FIG. 3 illustrates a view of the apparatus mounted on a table saw.

Turning now to the operation of the apparatus, reference is made to FIG. 3. As illustrated in FIG. 3, apparatus 10 has been firmly mounted against a face 52 of a fence 54, of a table saw 56. Saw 56 is a typical table saw having a flat table portion 58 upon which a piece of lumber 60 is laid upon, so that a blade member 62 protruding outward from the table portion 58, when it is circulating at high speed forms a cut 64 in lumber 60, as lumber is slid across the table 58 via guide 70. In the present state of the art, normally the end 72 of lumber 60 would be placed flush against a scrap of wood clamped to fence 54, and would be moved via guide 70 as the cut is made. As was discussed earlier, this is often undesirable in getting an accurate cut.

In FIG. 3, apparatus 10 has been clamped via clamp member 80, secured against the face 52 of fence 54, with the end 72 of lumber 60 placed flush against the face 36 of screw member 30. Therefore, as the lumber 60 is slid across the cutting blade 62, the distance that is being accommodated is the distance between the face 36 of screw member 30 and the cutting blade 62.

Figure 5:
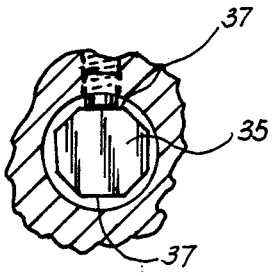
FIG. 5 illustrates a view along lines 5—5 in FIG. 4 thereof.
Figure 4:
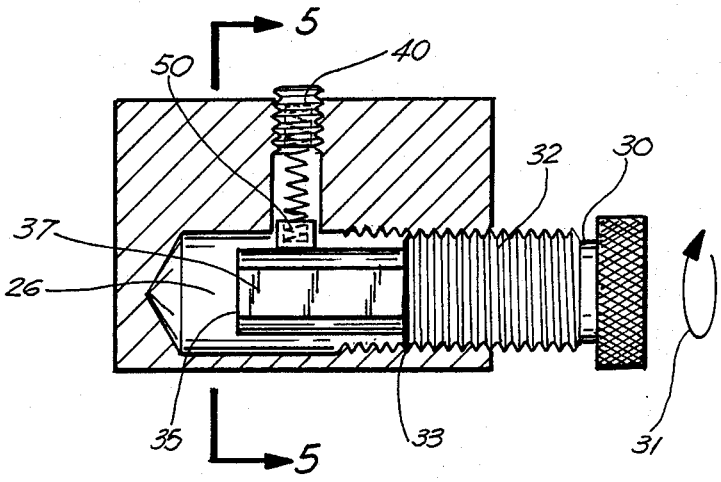
FIG. 4 illustrates a cross-sectional view of the preferred embodiment of the apparatus of the present invention.

Turning now to further functioning of apparatus 10, reference is made to the FIGS. 4 through 5. As illustrated, and as was discussed earlier, threadably screw 30, as seen more particularly in FIGS. 4 and 5, includes a first threaded shaft portion 32 substantially half-way up to the mid-point 33 of shaft 32. However, there is included a second section 35 of shaft 30, which is round with four flat sides thereon (FIG. 5), each of the sides 37 forming ¼ of the distance around the shaft as illustrated in the end view in FIG. 5. Therefore, the screw 30 is inserted into port 26, and threadably accommodated therein via threads 32, as illustrated in FIG. 4. After the screw has been inserted into port 26, second screw assembly 40 is inserted into second port 28, and a relationship is formed between the first screw member 30 and the second screw 40. This is clearly illustrated in FIG. 4.

Turning now to FIG. 4, one can see that the threaded shaft portion 32 is threadably engaged into port 26, with distal end portion 35 extending inwardly further into port 26, as illustrated. At this point, secondary screw 40 has been threadably engaged into port 28, and the end cap 50 has made contact with one of the sides 37 of distal end portion 35 as illustrated. Therefore, there is a slight force placed upon the shaft 35 of screw 30, as screw 30 would be rotated for example in the direction of arrow 31 in FIG. 4. Each of the sides 37, as discussed earlier, represents ¼ of a turn of the screw 30 when it is rotated. Furthermore, this calibration amounts to the screw head 34 of screw 30 moving inwardly or outwardly in the direction of arrow 37 (in FIG. 1), 1/64 of an inch. Therefore, one rotation of the screw head from a surface and returning it to that same surface, as would be seen in end view in FIG. 5, would therefore represent 1/16 inch movement of the screw head either inwardly or outwardly.

Therefore, if one were to wish to accurately align blade 62 with a cut line along wood piece 60, one would simply fixedly engage apparatus 10 onto fence 54, as illustrated in FIG. 3, with saw blade 62 slightly adjacent the cut line. Following the positioning, screw head 34 wold then be rotated in the direction in order to move the wood inwardly and, again with each complete rotation of the head, the cut line would be moved 1/16 of an inch. In order to properly ascertain the complete rotation of head 34, flat portion 34A of screw head 34 would serve as an indicator for one rotation of head 34. When flat edge 34A is returned to its original position, the head has of course been rotated one complete turn, and therefore the 1/16 of an inch movement has been accomplished. Therefore, the cut could be made quite accurately after the screw head has been aligned to the proper distance aligning the cutting blade with the cut line.

Furthermore, as illustrated in FIG. 1, apparatus 10 includes a pair of ports 71 and 73, these ports would be drilled completely through the body portion 12 of the apparatus, and in the event one wanted to permanently mount the apparatus, either to the base 58 of the saw 56, or to the fence member 54, one could do so through a pair of screws or the like during use.

For purposes of construction, apparatus 10 could be constructed of a light-weight material, such as aluminum, or the like, and could be utilized by mounting of multiple units.

The illustration of the use of apparatus 10, for example in FIG. 3, is merely exemplary of one of the uses of the apparatus. As was described earlier, 15 apparatus 10 may be used as an overall tool for accommodating a particular measurement against the end of a workpiece and that point in the workpiece that either has to be cut, molded, routed, or the like. In addition, it could be used to set any distance between two points, by the rotation of head 36 when a piece of material must be accurately measured in order to be placed in position. In addition, multiple apparatus 10 may be used in order to accomplish a particular task of the proper positioning of various types of workpieces.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus mountable on a table saw, for adjusting the cut of a board, the apparatus comprising:

(a) a body portion mountable onto the table saw;

(b) a first threaded member threadably into the outer face of the body portion, calibrated so that one complete rotation of the threadable member moves the threadably member a particular distance inwardly or outwardly from the face; and (c) means threadably into a second face of the apparatus for contacting a portion of the shaft of the threadable member, for defining a means to indicate the amount of segmental rotation of the threadable member as it rotates in its circular fashion.

2. The apparatus in claim wherein the body portion further comprises a solid piece of aluminum or light-weight metal.

3. The apparatus in claim wherein the first threaded member further comprises a shaft portion having four flat sides, wherein each of the sides represents ¼ of a 1/16 of an inch per full rotation.

4. The apparatus in claim 1, wherein the means for threading into a second face of the apparatus further comprises a second spring loaded screw member which makes contact with one of the four flat sides as that side is rotated in position against the end of the threaded means.

5. An apparatus mountable for adjusting the distance of a work piece in relation to a fixed point, the apparatus comprising:

(a) a body portion;

(b) a first principal bolt portion, having a flat head on a first end for accommodating the end of the work piece;

(c) a shaft portion, further comprising a threadable portion for threading into a port hole, and a second portion of the shaft for moving the member in a calibrated fashion; and (d) a second adjustable member threaded into a second port in the apparatus for making contact with the shaft of the bolt portion, so that as the shaft is rotated, the force directed onto the shaft indicates the distance of the shaft as rotated along its path of rotation.

* * * * *